US005265592A

United States Patent [19]

Beaussant

[11] Patent Number: 5,265,592

[45] Date of Patent: Nov. 30, 1993

[54] INDIVIDUAL PROTECTIVE BREATHING EQUIPMENT

[75] Inventor: Raymond Beaussant, Bretigny, France

[73] Assignee: Intertechnique, France

[21] Appl. No.: 842,317

[22] Filed: Feb. 28, 1992

[30] Foreign Application Priority Data

Feb. 28, 1991 [FR] France ..... 91 02412

[51] Int. Cl.[5] ..... A62B 17/00

[52] U.S. Cl. ..... 128/201.24; 128/201.29; 128/204.17; 128/206.12

[58] Field of Search ..... 128/201.22–201.25, 128/201.28, 201.29, 204.17, 204.18, 205.22, 205.25, 206.12, 205.29

[56] References Cited

U.S. PATENT DOCUMENTS

| | | | |
|---|---|---|---|
| 4,276,877 | 7/1981 | Gdulla | 128/200.27 |
| 4,403,608 | 9/1983 | Warneke | 128/201.29 |
| 4,404,969 | 9/1983 | Cresswell et al. | 128/201.23 |
| 4,503,850 | 3/1985 | Pasternak | 128/201.25 |
| 4,534,344 | 8/1985 | Constance-Hughes | 128/201.28 |
| 4,549,541 | 10/1985 | Sundahl | 128/201.26 |
| 4,671,268 | 6/1987 | Hunt | 128/204.17 |
| 4,683,869 | 8/1987 | Wilcox | 128/204.17 |
| 4,741,332 | 5/1988 | Beaussant | 128/201.25 |
| 4,831,664 | 5/1989 | Suda | 128/205.29 |
| 4,881,539 | 11/1989 | Pasternack | 128/201.29 |
| 4,964,405 | 10/1990 | Arnoth | 128/205.22 |
| 5,181,506 | 1/1993 | Tardiff, Jr. et al. | 128/201.23 |

FOREIGN PATENT DOCUMENTS

| | | | |
|---|---|---|---|
| 1202141 | 9/1965 | Fed. Rep. of Germany . | |
| 2074456 | 11/1981 | United Kingdom . | |
| 2076133 | 11/1981 | United Kingdom | 128/201.29 |
| 2164570 | 3/1986 | United Kingdom . | |
| 2191950 | 12/1987 | United Kingdom . | |
| 2220574 | 1/1990 | United Kingdom | 128/201.22 |

*Primary Examiner*—Edgar S. Burr
*Assistant Examiner*—Lynn D. Hendrickson
*Attorney, Agent, or Firm*—Larson and Taylor

[57] ABSTRACT

An individual breathing equipment comprises a head covering provided with a neck joint defining a space which is separated from the outside all around the head and a mask for isolating the respiratory tract. The mask is provided with a breath-in valve and with a breath-out valve exhausting directly to the atmosphere. The breathable gas feed circuit opens into the space defined by the head covering. The outlet of the feed circuit and the outlet of the breath-in valve for taking air from said space are so located that the breathable gas ventilates the head before reaching the breath-in valve. A buffer volume is placed upstream of the opening into said space, defined by a breastplate.

12 Claims, 3 Drawing Sheets

INDIVIDUAL PROTECTIVE BREATHING EQUIPMENT

BACKGROUND OF THE INVENTION

The invention relates to individual breathing equipment for use by personnel who are required to act under hostile surroundings of a nature that requires protection not only for the respiratory passages, but also for the body or at least the entire head. By way of example, mention may be made of equipment for use by firemen who need protection against smoke, and equipment for providing NBC (nuclear, biological, chemical) protection.

Individual equipment is already known comprising a head covering (often reduced to a face-cover with) delimiting the space that is separated from the surroundings and a mask for isolating the respiratory passages, and provided with a breath-in valve and a breath-out valve. The breathable gas may be atmospheric air, sucked in through a filter, when protection is necessary, or it may come from a supply associated with the equipment.

Among the drawbacks suffered by existing equipment in which the breathable gas penetrates directly into the mask, special attention can be given to the fact that the portion of the head enclosed in the covering is not ventilated, which gives rise to discomfort that considerably limits the tolerable wearing time, particularly if the covering contains both the head and the neck.

SUMMARY OF THE INVENTION

It is an object of the invention to provide improved breathing equipment of the above-defined type. It is a more specific object to provide equipment having a covering enclosing the entire head and enabling the temperature of the chest and the head to be conditioned.

To this end, the present invention provides individual breathing equipment comprising a head covering delimiting a space which is separated from the outside all around the head, and a mask for isolating the respiratory passages, the mask being provided at least with a breath-in valve and with a breath-out valve exhausting directly to the atmosphere, the breathable gas feed circuit opening into the space delimited by the head covering, the location of the outlet from the feed circuit and the location of the breath-in valve for taking air from said space being such that the breathable gas ventilates the head before reaching the breath-in valve, the equipment being characterized in that an additional buffer volume is placed in the breathable gas feed to said space. The additional volume may be defined by a breastplate extending the covering and possibly fast therewith when the covering is a hood provided with a neck joint.

In this definition, the term "mask" must be interpreted widely as being capable of designating not only a piece covering the mouth and the nose only, but also an assembly constituted by a front portion of the covering and a face joint that includes or constitutes the breath-in valve and that surrounds the nose, the mouth, and generally also the eyes.

With head ventilation ensured in this manner, discomfort is greatly reduced. In addition, the space defined by the covering and the buffer volume acts as an economizer when the gas feed comes from a supply. The lower portion of the breastplate is provided with a coupling for connection to means for feeding it with atmospheric air, generally via a filter installed using an air-tight fast action coupling, or for feeding it with breathable gas coming from a supply, possibly under pressure, and provided with a coupling of the same type.

When a component such as a filter that imposes a head loss that increases rapidly with flow rate is placed upstream from the deformable buffer volume, the buffer volume considerably reduces rate peaks while breathing-in, and thus reduces breathing fatigue. When the equipment is fed with gas supplied by a source, the presence of the deformable buffer volume makes it possible to reduce considerably the maximum instantaneous flow rate required from the source, for a given mean flow rate.

The mere presence of the breastplate having fresh air or oxygen flowing therethrough serves to remove some of the metabolic heat given off by the chest.

To give the breathable gas an optimal temperature for ventilating the head and for breathing and for removing the heat given off by the chest, a heat exchanger may be provided under the breastplate. It may optionally belong to a jacket having a back that also contains a heat exchanger.

The heat exchanger may be constituted, in particular, by a serpentine array of flexible ducts secured between two sheets of a textile article.

Still in the case where components are placed upstream from the buffer volume that impose a head loss which increases rapidly with flow rate (e.g. a filter) or for which it is desirable to reduce the instantaneous flow rate (e.g. a blower), the buffer volume is advantageously designed to attenuate flow rate peaks while breathing in by mechanically drawing in gas while the wearer of the equipment is breathing out. It would be possible to place resilient components in a pocket of the breastplate that are compressed when the pocket is flattened under the effect of vacuum due to breathing-in at the end of taking a breath, and that expand the pocket during breathing out thereby drawing in a volume of fresh gas that will be breathed in at the beginning of the next breath. In any event, such components will prevent clogging.

The invention will be better understood on reading the following description of particular embodiments given as non-limiting examples.

DETAILED DESCRIPTION OF EMBODIMENTS

Figure 1:
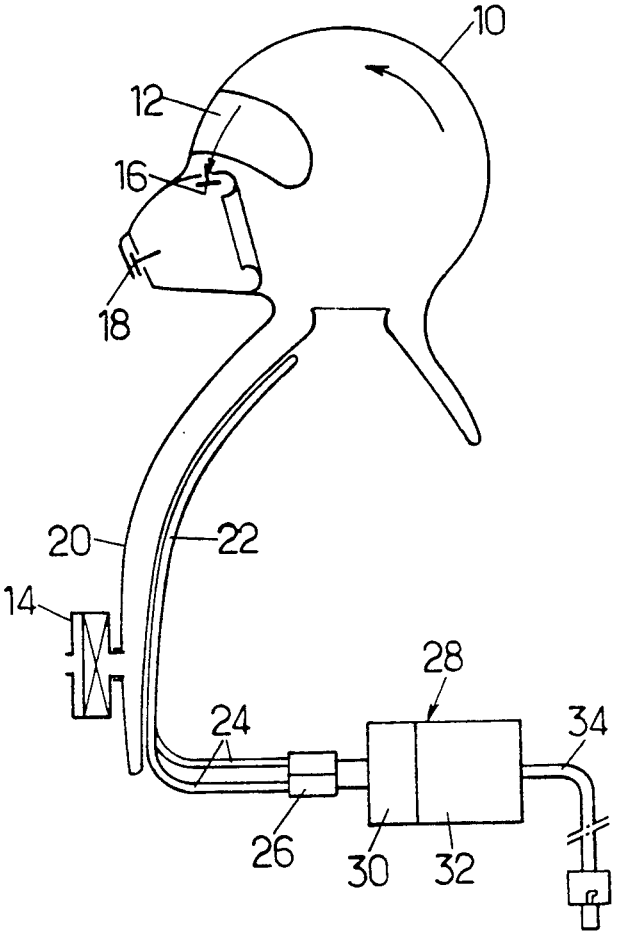
FIG. 1 is a diagram of equipment constituting one particular embodiment of the invention and fed with atmospheric air through a filter.

The equipment shown diagrammatically in FIG. 1 is designed to be fed with atmospheric air through a protective filter, e.g. an NBC filter. The equipment comprises a flexible head covering 10 which may be considered as constituting a hood, provided with a transparent visor 12 and with a mask having a gasket that is applied in substantially air-tight manner to the face around the nose and the mouth. A portion of the shell of the mask may be constituted by the front of the hood, or it may be disposed inside the hood.

The covering 10 receives atmospheric air through a filter 14 fixed to a rapid-action coupling and through a deformable buffer volume that enables flow rate peaks through the filter 14 to be reduced. The mask is fed from the space delimited by the hood 10 via a breath-in nonreturn valve 16. The outlet from the buffer volume into the covering 10 and the valve 16 are placed in such a manner as to ensure that the air breathed in ventilates the head before reaching the valve 16.

The mask also includes a breath-out valve 18 which opens out directly to the atmosphere so that the space between the covering and the head does not become loaded with water vapor.

In the embodiment shown by way of example in FIG. 1, the buffer volume is constituted by a breastplate 20 which performs several functions either separately or simultaneously, depending on the circumstances.

It serves to reduce the flow rate peaks through the filter 14 and therefore to reduce breathing fatigue since pressure losses vary approximately with the square of the instantaneous flow rate when a filter is provided.

The inside face of the breastplate constitutes a heat exchange surface enabling heat to be evacuated from the chest. It can thus be seen that the simple form of the equipment as described above enables heat to be evacuated from the chest, thereby improving comfort, under all conditions and in particular when absence of pollution may make it possible temporarily to do without the filter.

In the particular example shown in FIG. 1, comfort is further improved by the inside face of the breastplate being put into contact with a fluid flow heat exchanger (generally liquid flow) that is sufficiently flexible to fit around the chest. The heat exchanger may be constituted, in particular, by a flexible tube constrained to follow a sinuous path between two sheets of cloth. The hydraulic circuit of a heat exchanger 22 constituted in this manner is provided with inlet and outlet lines 24 suitable for connecting via a coupling 26 to a liquid conditioning unit 28. The conditioning unit may be constituted, for example, by a circulation pump 30 and by a refrigerator component 32. They receive power from an electrical power cord 34 or from any other appropriate means. F To reduce heating from the ambient atmosphere, the breastplate 20 may be provided with an insulating layer on its outside face. The atmospheric air sucked in through the filter 14 at the base of the breastplate 20 by natural breathing is then cooled prior to reaching this space surrounding the head. When such an exchanger is provided, the equipment has an advantage in surroundings that are not toxic (not requiring a filter) but that are hot or very cold.

Figure 2:
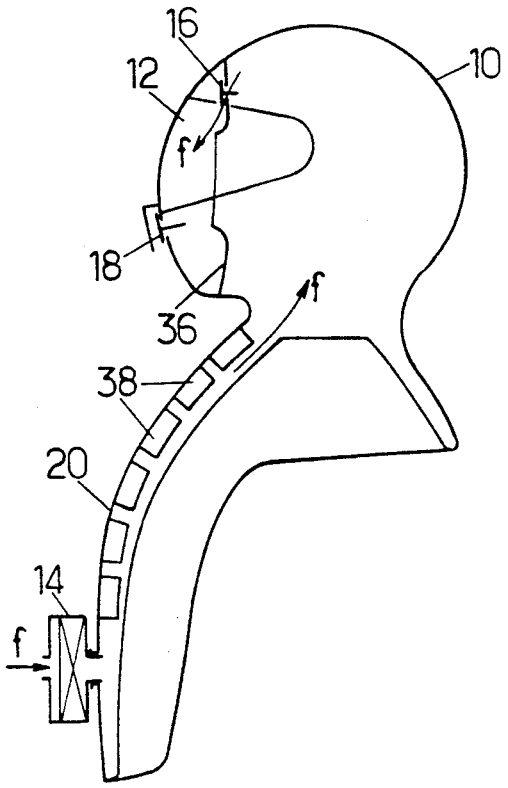
FIG. 2 and 3 show modified embodiments.

The equipment shown diagrammatically in FIG. 2, (where components corresponding to those shown in FIG. 1 are designated by the same reference numerals), includes a mask which is constituted merely by the front portion of the hood. The front portion is separated from the space surrounding the remainder of the head by a face gasket 36 that carries the breathing valve 16 or that constitutes said valve.

In addition, FIG. 2 shows a breastplate 20 which contains resilient components 38 that are designed to be compressed by being clamped between the two sheets constituting the breastplate when the pressure inside the breastplate is lower than the atmospheric pressure, and to expand thereafter. These resilient components 38 may be constituted, in particular, by blocks of elastomer material fixed on one of the sheets of the breastplate and regularly distributed thereover. However, this distribution is not essential: the essential point is to avoid clogging by one of the walls pressing completely against the other.

Figure 3:
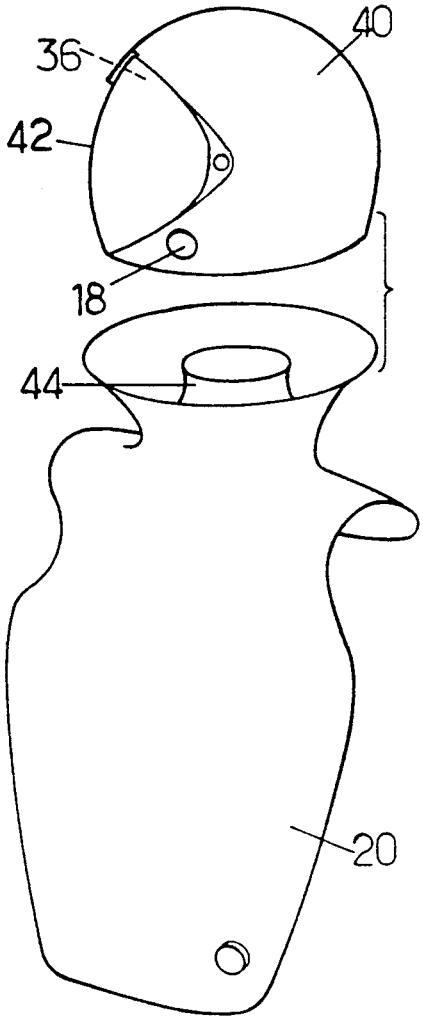

Finally, the equipment shown in FIG. 3 differs from that shown in FIG. 2 in that the head covering is constituted by a helmet 40 having a movable visor 42.

When the visor 42 is down, it is sealingly applied against the front opening in the helmet and constitutes the equivalent of a mask by cooperating with a face joint 36. Under such circumstances, the helmet 40 carries the breath-out valve or valves 18. The helmet may be sealingly fixed to the breastplate 20. The breastplate is provided with a neck gasket 44 in the form of a collar 44. The helmet is removably and sealingly connected to the breastplate. The connection may include a sealed ball bearing of known type, but which is advantageous only in conjunction with a compressed oxygen feed, as described below.

Figure 4:
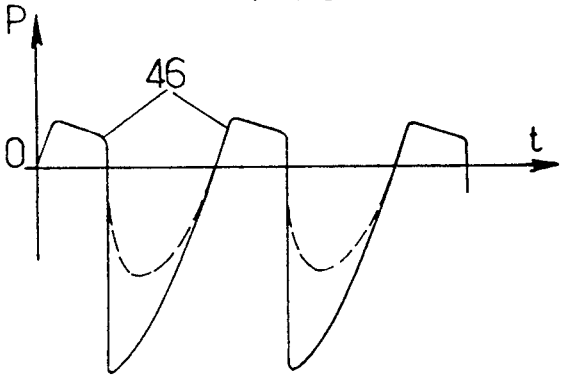
FIG. 4 is a curve showing how the pressure that prevails in the mask varies as a function of time, both in a conventional type of installation (solid line curve) and in equipment of the invention (dash-lined curve), in the case of breathing from the atmosphere.
Figure 1A:
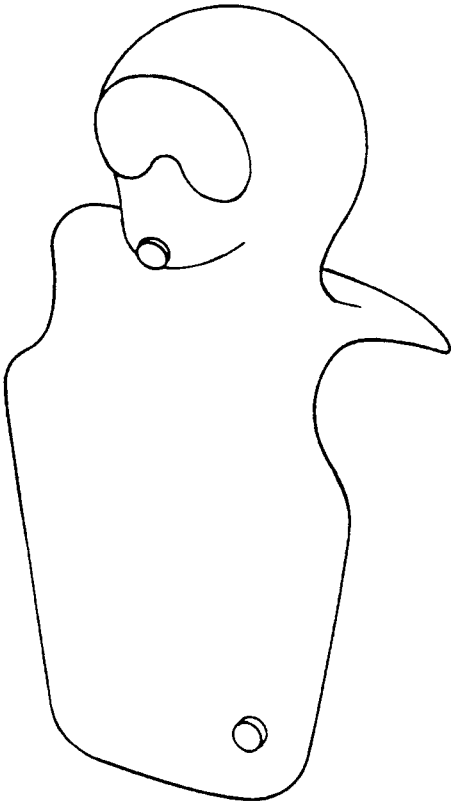
FIG. 1*a* is a simplified view of the equipment of FIG. 1 shown in perspective and without a heat exchanger.

The presence of a buffer volume makes it possible to eliminate peaks from the flow rate through the filter 14. In solid lines, FIG. 4 shows how the pressure inside the mask varies relative to ambient pressure during cycles of breathing. In conventional equipment, the pressure inside the mask is slightly greater during breathing out, (as shown in 46) because of the pressure loss caused by the breath-out valve 18. While breathing in, the suction caused by the breath-in valve 16 and by the head loss of through the filter 14 becomes large, as shown by the solid line curve, since the necessary volume of air passes through the cartridge only during periods of breathing-in.

The flow rate peak through the filter 14 is considerably reduced in equipment that includes a breastplate 20 having a large buffer volume: during the initial stage of breathing-in, the breastplate empties such that the volume that needs to be drawn through the filter is smaller.

The amount of underpressure that is required, and thus the amount of breathing effort that is required, can be greatly reduced when the buffer volume is provided with resilient means between its walls, such as the means shown in FIG. 2. The resilient means are compressed by the bag collapse caused by atmospheric pressure when breathing-in suction appears. During breathing-out, the resilient components expand and cause the buffer volume to be filled through the cartridge 14. The mean flow rate through the filter then becomes relatively constant. This avoids flow rate peaks and reduces the amount of underpressure, as shown by dashed lines in FIG. 4. The presence of such means is not essential in any way. In the option described below where air is fed under pressure by a regulator or by a blower, such means would have an effect only in the event of a failure.

Figure 5:
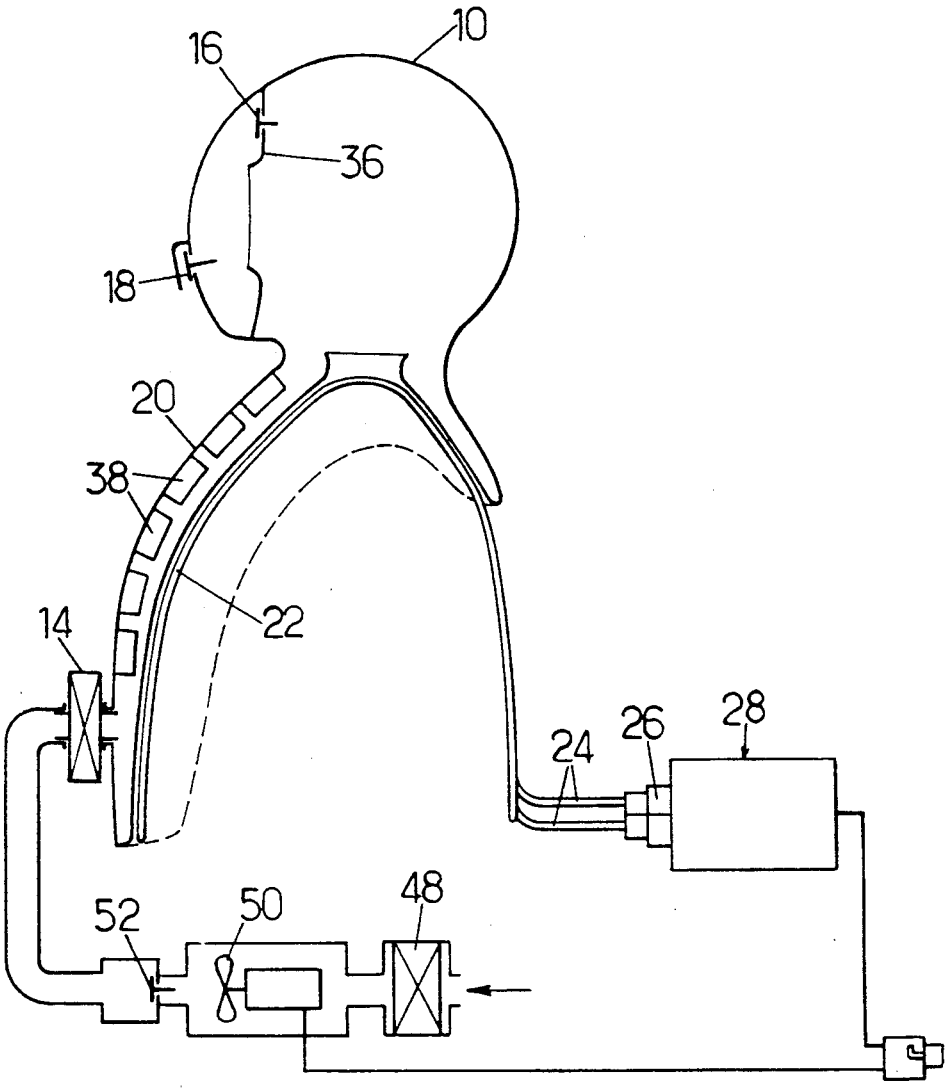
FIG. 5 shows equipment that differs from that of FIG. 1 in that it is fed with atmospheric air that is compressed by a blower provided with at least one filter.

The embodiment shown diagrammatically in FIG. 5 (where components corresponding to those described above continue to be given the same reference numerals) is designed to be fed with atmospheric air by a blower. The air inlet of the filter 14 is connected to a feed unit comprising, in succession, a filter cartridge 48, a blower 50 having an electric motor, and a non-return valve 52.

The presence of the breastplate makes it possible for the flow rate required of the blower to be reduced considerably. For example, if the mean flow rate or "ventilation flow rate" is 30 l/mn, then the peak flow rate that would be required of the blower 50 if it were to feed the mask directly, would be about 100 l/mn. However, if the buffer volume is greater than the variation of the lung volume, then the peak can be reduced to 30 l/mn. The power required of the electric drive motor for the blower can be divided by three or the operating time of a given electrical battery can be multiplied by three; the life time of filter cartridges is likewise multiplied by three.

Figure 6:
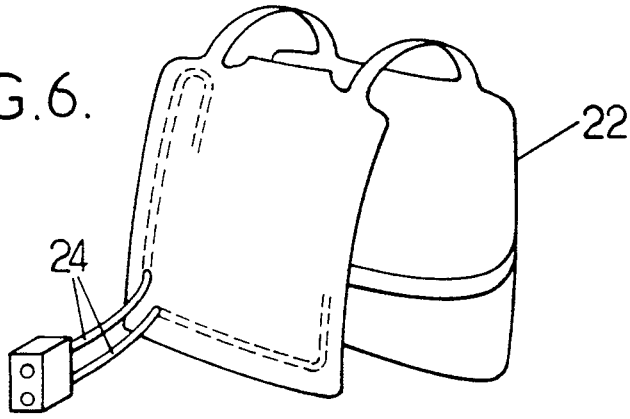
FIG. 6 shows one possible configuration for the heat-removing jacket of FIG. 5.

The heat exchanger provided in the equipment of FIG. 5 can also remove heat from the back of the wearer if it constitutes a jacket that has the general shape shown in FIG. 6, having a back portion in addition to its front portion which is for location between the breastplate 20 and the protective clothing of the wearer, or for location beneath said clothing.

Figure 7:
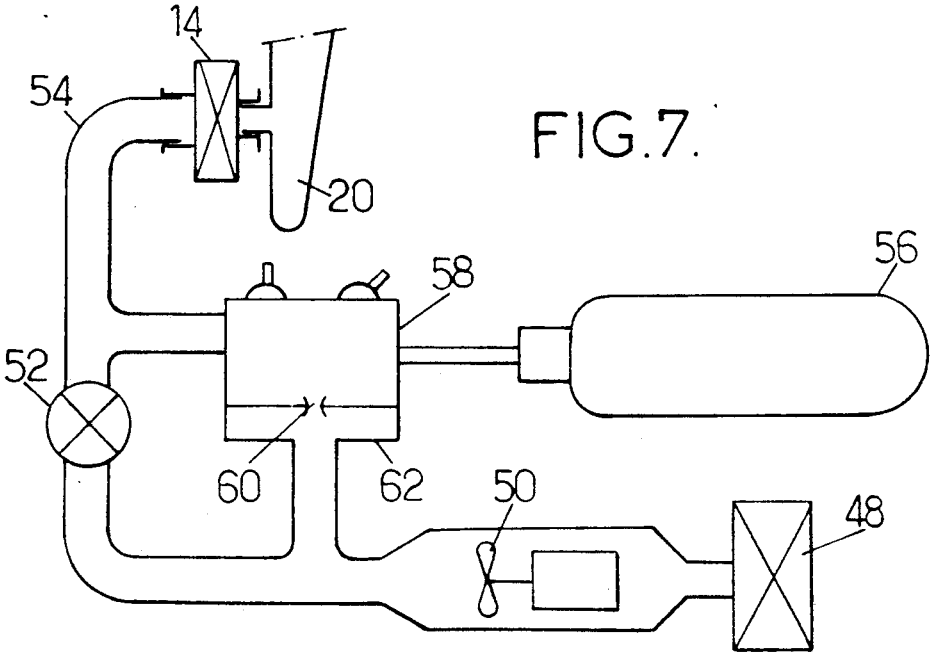
FIG. 7 shows a possible modification of the equipment of FIG. 5, enabling breathable gas to be supplied either from the atmosphere or else from a source of oxygen, with or without dilution.

FIG. 7 shows only the portion that feeds the filter 14 (or the breastplate directly) in yet another embodiment. The equipment shown in FIG. 7 can supply the wearer of the equipment either with atmospheric air (filtered or not filtered), or else with oxygen diluted by atmospheric air, or else with pure oxygen, thereby providing NBC protection. To do this, the duct 54 feeding the filter 14 is branched. One of the branches is fed by the blower and includes a cock 52. The other branch includes a source of oxygen such as a cylinder 56 of oxygen under pressure, and a demand regulator 58, which is provided with a switch for switching it on and off, and for enabling it to provide oxygen that is pure or that is diluted by air drawn via an opening 60 in its housing. To ensure that the air sucked in is itself de-polluted, the air is not taken directly from the atmosphere but from a space that communicates with the atmosphere only via a filter 48. This space may be delimited by a case 62 as described in U.S. Pat. No. 4,741,332 or European patent No. 153 247.

The embodiment of FIG. 7 makes it possible to provide NBC protection both when breathing is merely assisted by the blower 50 (with temperature being conditioned by the heat exchanger and with head ventilation being provided by the blower), and when breathing oxygen that is pure or that is diluted. When such protection is not required, the filter 14 and the blower may be omitted.

With simple modifications, the equipment of the invention is capable of providing breathable gas under pressure, e.g. for use in altitude. Under such circumstances, the breath-out valve 18 should be replaced by a compensated breath-out valve and an appropriate regulator of known type should be used.

Under such circumstances, the breastplate has the additional function of pressurizing the chest and it enables a conventional pressurized jacket to be omitted. On such circumstances, the breastplate may be extended over the back and/or over the arms to protect those parts as well.

The equipment described above may be made in the form of modules that can be separated from one another, particularly when the equipment is as shown in FIG. 3, the breathing breastplate constitutes a module provided with a coupling for receiving a filter cartridge directly or for receiving a breathing assistance assembly such as that shown in FIG. 5. The heat exchanger constitutes an additional equipment for placing beneath the breastplate. It should be observed that the equipment makes it possible to avoid any pipework that opens out directly into the head gear.

I claim:

1. Individual breathing equipment comprising:

a head covering adaptated to be worn by a wearer, to totally enclose the head of the wearer, and to define, around the head, a space separated from the external atmosphere;

a mask arranged in use to define with the face of the wearer an inner volume in communication with the respiratory tract of the wearer, said mask being provided with a breath-out valve directly opening to atmosphere and with a breath-in valve for permitting breathable gas to enter said inner volume from said space;

a breastplate arranted in use to be applied on the breast of the wearer and defining a closed deformable buffer volume;

a passage communicating said closed deformable buffer volume and said inner volume; and means for delivering breathable gas to said buffer volume, whereby said buffer volume, said passage, said space and said inner volume constitute a breathable gas circuit feeding said respiratory tract;

wherein said breath-in valve and said passage between said buffer volume and said space are so located that the breathable gas flows along a path around the head before reaching the breath-in valve.

2. Equipment according to claim 1, further comprising a heat exchanger located under said breastplate.

3. Equipment according to claim 2, wherein said heat exchanger constitutes an element of a coat arranged in use to be applied against the waist of the wearer, further comprising means for circulating a temperature control liquid through said heat exchanger.

4. Equipment according to claim 1, wherein said breastplate has two sheets defining said closed deformable buffer volume and a plurality of resilient components fixed on one of said sheets and arranged for being compressed between said sheets when the wearer of the equipment inhales air from the atmosphere.

5. Equipment according to claim 1, wherein said breastplate is unitary with the covering.

6. Equipment according to claim 5, wherein said covering is a hood provided with a joint sized to apply against a neck of the wearer.

7. Equipment according to claim 1, wherein said means for delivering breathable gas to said buffer volume comprises a coupling located at a lower portion of said breastplate, for connection with breathable gas delivering means.

8. Equipment according to claim 7, wherein said breathable gas delivering means comprises a blower drawing air from atmosphere and an air filter.

9. Equipment according to claim 7, wherein said breathable gas delivering means comprises a source of pressurized breathable gas and a demand regulator.

10. Equipment according to claim 9, wherein said regulator has an inlet for drawing dilution air drawn from a space which is separated from atmosphere by filtering means.

11. Individual breathing equipment to protect a wearer against hostile environment, comprising:

a hood arranged in use to enclose the head of a wearer and to define, around the head, a space separated from the external atmosphere;

a mask contained in said hood and arranged in use to define with the face of the wearer an inner volume in communication with the respiratory tract of the wearer, said mask being provided with a breath-out valve directly opening to atmosphere and with a breath-in valve for permitting breathable gas to enter said inner volume from said space;

a breastable arranged in use to be applied on the breast of the wearer and defining a deformable buffer volume;

a passage communicating said deformable buffer volume and said inner volume;

means for delivering breathable gas to said buffer volume, whereby said buffer volume, said passate, said space and said inner volume constitute a breathable gas feed circuit;

a heat exchanger located under said breastplate; and means for circulating a cooling liquid within a cooling circuit including said heat exchanger;

wherein said breath-in valve and said passage between said buffer volume and said space are so located that the breathable gas flows around the head before reaching the breath-in valve.

12. Individual breathing equipment to protect a wearer against hostile environment, comprising:

a hood arranged in use to enclose the head of a wearer and to define, around the head, a space separated from the external atmosphere;

a mask contained in said hood and arranged in use to define with the face of the wearer an inner volume in communication with the respiratory tract of the wearer, said mask being provided with a breath-out valve directly opening to atmosphere and with a breath-in valve for permitting breathable gas to enter said inner volume from said space;

a breastplate arranged in use to be applied on the breast of the wearer and defining a deformable buffer volume;

passage means communicating said deformable buffer volume and said inner volume;

means for delivering breathable gas to said buffer volume, whereby said buffer volume, said passage, said space and said inner volume defining a breathable gas feed circuit;

a heat exchanger located under said breastplate; and means for circulating a cooling liquid within a cooling circuit including said heat exchanger;

wherein said breath-in valve and said passage means between said buffer volume and said space are so located that the breathable gas sweeps the head before reaching the breath-in valve. F

* * * * *